United States Patent [19]

Tomosue

[11] Patent Number: 4,649,692

[45] Date of Patent: Mar. 17, 1987

[54] APPARATUS FOR APPLYING A LABEL TO PACKAGES OF EGGS OR THE LIKE

[76] Inventor: Hiroshi Tomosue, 1855, Shimoyokono, Tuyama City, Okayama Prefecture, Japan

[21] Appl. No.: 715,431

[22] Filed: Mar. 25, 1985

[51] Int. Cl.[4] ..... B65C 9/02; B65C 9/14; B65C 9/42

[52] U.S. Cl. ..... 53/137; 53/248; 156/364; 156/497; 156/51; 156/DIG. 25; 156/DIG. 31; 156/DIG. 45; 271/99; 271/245

[58] Field of Search ..... 156/362, 364, 497, 521, 156/569, 570, 571, DIG. 23, 24, 25, 31, DIG. 45; 53/238, 248, 137; 271/245, 107, 99

[56] References Cited

U.S. PATENT DOCUMENTS

| | | | |
|---|---|---|---|
| 2,643,120 | 6/1953 | Jackson | 156/DIG. 31 |
| 2,895,274 | 7/1959 | Mumma | 53/248 |
| 2,956,612 | 10/1960 | Gaines et al. | 156/521 |
| 3,169,354 | 2/1965 | Bliss et al. | 53/248 |
| 3,797,822 | 3/1974 | Anderson | 271/99 |
| 4,293,365 | 10/1981 | Geyser et al. | 156/364 |

*Primary Examiner*—Michael Wityshyn
*Assistant Examiner*—J. Davis
*Attorney, Agent, or Firm*—Armstrong, Nikaido, Marmelstein & Kubovcik

[57] ABSTRACT

In an apparatus for applying a label to packages filled with eggs or the like in a state without a cover in the packaging operation and moving one by one on a conveyor beneath the apparatus, a sucking disk for taking out the labels one by one from a label feeder is provided between the upper label feeder and a lower label-posture adjusting chamber in a way freely movable in the vertical direction. An air pipe, connected to the sucking disk, is opened and closed in accordance with the up-and-down motions of the sucking disk, which is controlled by a signal from a sensor for detecting the presence of a label inside the label-posture adjusting chamber. The bottom of the label-posture adjusting chamber is opened by detecting the approach of a package.

4 Claims, 5 Drawing Figures

APPARATUS FOR APPLYING A LABEL TO PACKAGES OF EGGS OR THE LIKE

BACKGROUND AND SUMMARY OF THE INVENTION

The present invention relates to an apparatus for applying a label one by one to packages filled with eggs or the like and without a cover and are moving along a conveyor belt.

When eggs are sold in the retail stores, for example, it is the general practice that six or twelve eggs are packed in two rows in an egg pack, which is provided with separate compartments for accepting individual eggs to prevent mutual contact to each other. Usually, the acute or pointed end of the egg is placed upward and the obtuse or rounded end is placed on the bottom side.

Automatic packaging machines for eggs have made substantial progress recently, and the automation of retail packaging has been widely propagated in a very short time. Following this trend, there is a demand for automatic application of a label which is to indicate size symbols, name of the producer as well as the date packed and so on into the packages.

However, it is difficult as well as troublesome to mechanize the application of a label into a fixed position of egg packs one by one precisely at a narrow space between two rows of eggs while the packages are being conveyed at a fairly high rate of speed. Accordingly, labels are now attached manually as they have been in the past. In order to solve the problem mentioned above, the present invention comprises a sucking disk connected to a vacuum means and an air valve for removing labels one by one from a label feeder. This invention is disposed between the label feeder arranged in an upper portion and the label-posture adjusting chamber arranged in a lower portion and the sucker disc is freely swingable in a vertical direction. The air valve is opened and closed by the swing motion of the sucking disk, which is controlled by a signal from a sensor detecting the presence of the label inside the label-posture adjusting chamber. The bottom of the label-posture adjusting chamber is opened by detecting the approach of the package.

By such arrangement, labels can be applied one by one precisely onto the packages without covers and filled with eggs or the like and being conveyed at a fairly high rate of speed by the conveyor.

Namely, it is an object of the present invention to apply one label at a time precisely onto the packages.

It is another object of the present invention to correctly adapt to the conveyor speed of the packages.

It is a further object of the present invention to provide an apparatus which is robust in structure and low in cost.

BRIEF DESCRIPTION OF THE DRAWINGS

An embodiment of an apparatus for applying a label into the egg packages is illustrated in the following drawings wherein.

In FIG. 3, an operation before the opening a label-posture adjusting chamber is shown, and in FIG. 4, an operation after the label-posture adjusting chamber is open is shown.

DESCRIPTION OF THE PREFERRED EMBODIMENTS

Figure 1:
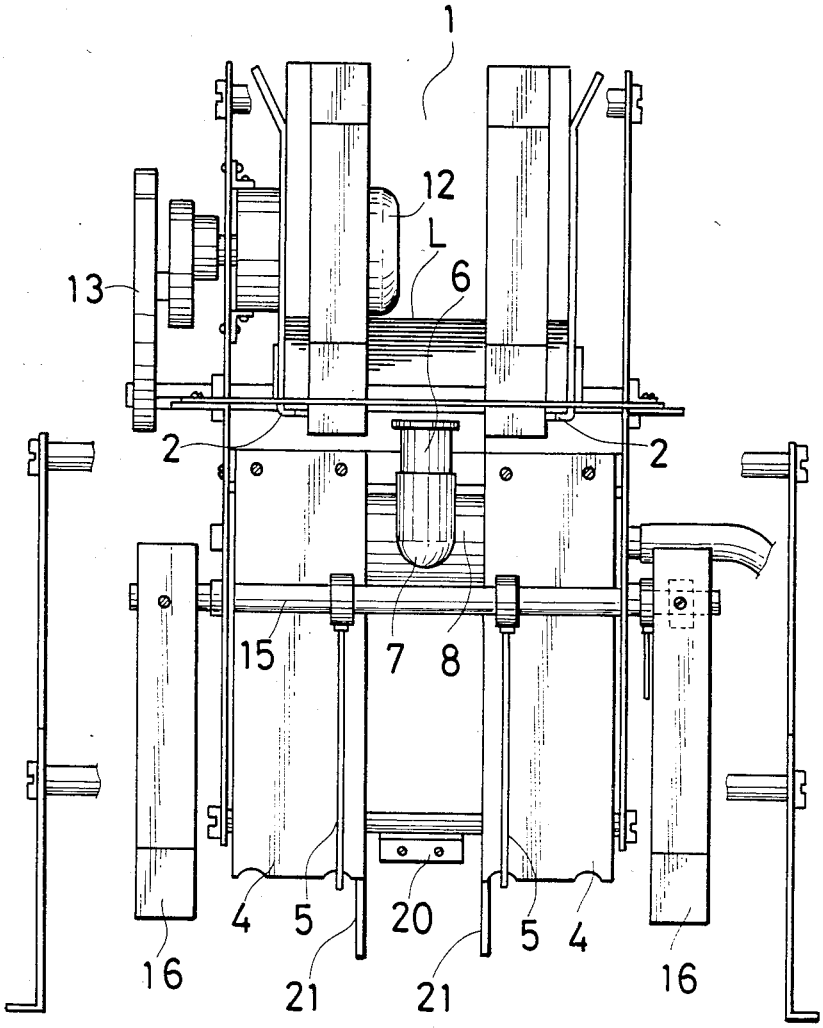
FIG. 1 is a front elevational view.
Figure 2:
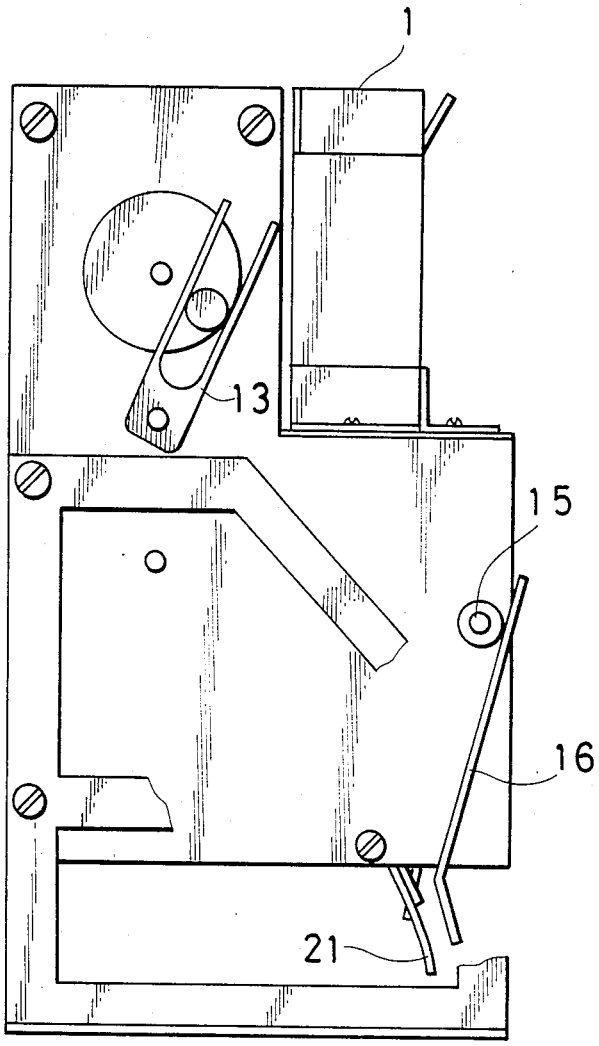
FIG. 2 is a side elevational view.
Figure 3:
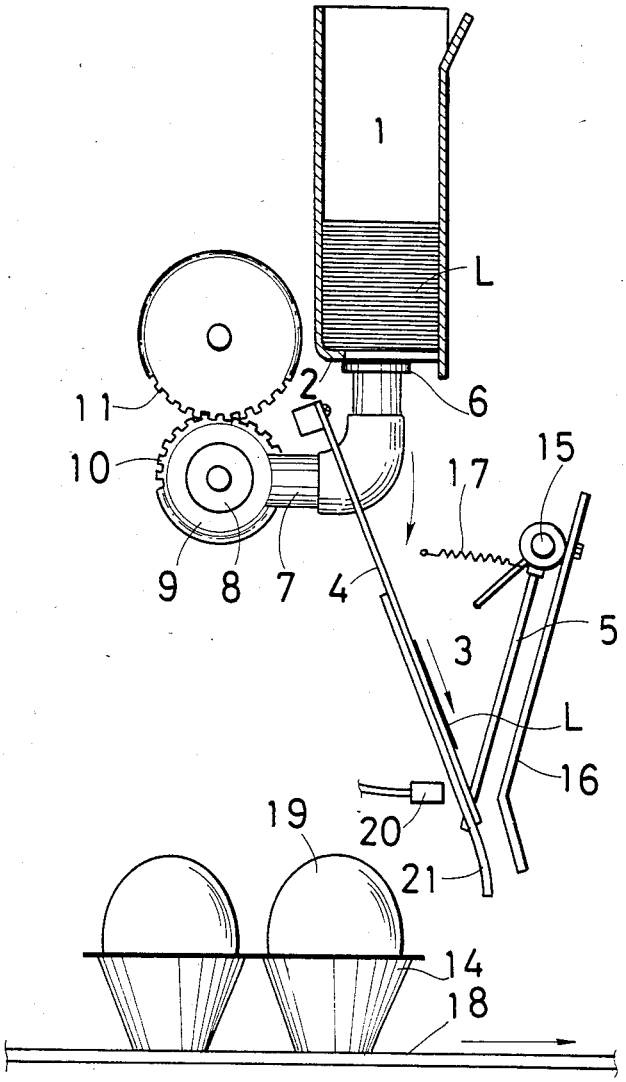
FIGS. 3 and 4 are side views illustrating the operations for applying a label.
Figure 4:
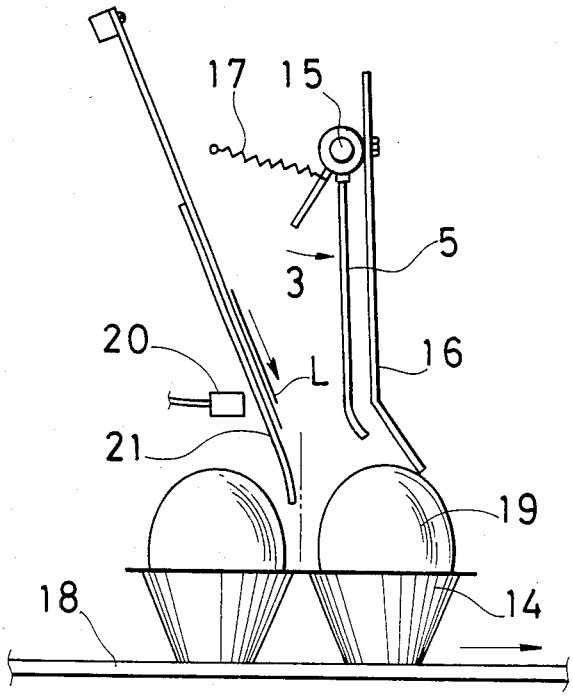
Figure 5:
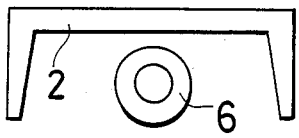
FIG. 5 is a plan view showing one example of the bottom shape of a label feeder.

In the drawings, numeral 1 designates a label feeder with the bottom having an opening. Label supports 2 are positioned on three sides as shown in FIG. 5.

Numeral 3 designates a label-posture adjusting chamber arranged beneath the label feeder 1, as previously mentioned, and comprises a vertical label support member 4 and an opening and closing member 5 facing member 4 to form a V-shaped structure.

Numeral 6 indicates a sucking disk, which is mounted to a movable arm 7 which pivots up and down with respect to the vertical direction between the label feeder 1 and the label-posture adjusting chamber 3. The sucking disk 6 is connected to a suitable vacuum means (not shown) via an air valve 8, which is opened and closed with the up and down motions of said disk. In the drawing, an example is shown wherein, the rotary type air valve 8 is mounted horizontally and the movable arm 7 is affixed together with a gear 10 to a rotor 9, which moves by a driving motor 12 and a cam 13.

The timing relation between the opening and closing of air valve 8 and movable arm 7 is such that when the sucking disk 6 moves upward, one sheet of labels L is sucked out from the bottom of the feeder 1, and is released when it moves downward and approaches the label-posture adjusting chamber 3.

Since the label-posture adjusting chamber 3 has a V-shaped configuration due to the vertical label support member 4 and the opening and closing member 5 facing member 4 in a V-shape, the label L fed to the label-posutre adusting chamber 3 keeps a fixed vertical position in conformity with the shape of the label-posture adjusting chamber. This position ensures a minimum air resistance when the label falls onto a package 14, accordingly, a sufficient falling speed can be obtained and there is hardly any fear of deformed posture during the fall.

The opening and closing of the bottom of the label-posture adjusting chamber 3 may be accomplished in the following manner. That is, by affixing a contact arm 16 to an axis 15 which is coaxial with the opening and closing member 5, and stretching a return spring 17, a V-shaped bottom of the label-posture adjusting chamber is adapted to open and close immediately after the label L falls out instantaneously when a top end of the egg 19 packed in the package 14 and being conveyed by a conveyor 18 touches said contact arm 16. Besides, the bottom of the label-posture adjusting chamber 3 may not be opened and closed by providing the sensor for sensing the approach of the package 14 and by the signal therefrom.

In the drawing, there is shown an example, wherein a reflector type photosensor 20 is arranged in a gap between the two label support members 4, 4 forming the label-posture adjusting chamber 3, and for supplying the succeeding label after the label L in the label-posture adjusting chamber 3 has fallen. The motor 12 is driven by the signal from the sensor 20, which has detected the absence of the label L.

On the lower end of the label support member 4, a flexible guide member 21 is projecting downward, and the length of the lowermost end thereof is set to reach the mutual gaps formed between the eggs 19, thus the label fallen from the positioning chamber 3 drops along the guide member 21, and rests in a fixed vertical position in a narrow gap formed between the front and rear eggs 19.

In general, the higher the speed of the eggs 19, the more air turbulence occurs near the upper surface of the eggs, which tends to disturb the position and direction of the falling labels, but the guide member 21, mentioned above, may sufficiently prevent such defects.

As mentioned above, the present invention is capable of putting labels one by one onto a precisely fixed position not only for eggs but also for other similar kinds of foodstuffs and so on. Moreover, the construction is very simple and robust.

What is claimed is:

1. An apparatus for applying labels between two rows of eggs or the like in packages moving underneath the apparatus on a conveyor belt, said apparatus comprising:

a label feeder containing a supply of labels;

a label-posture adjusting chamber disposed below said label feeder;

a sucking disk connected to a vacuum source through a valve, said disk being movable between said label feeder and said label-posture adjusting chamber to transfer individual labels from said label feeder to said label-posture adjusting chamber, the movement of said sucking disk causing the opening and closing of said valve;

a sensor means for detecting the presence of a label in said label-posture adjusting chamber and providing a signal to control the movement of said sucking disk; and a member operatively attached to said label-posture adjusting chamber and responsive to the passage of one of said packages therebeneath to open a bottom portion of said label-posture adjusting chamber to allow a label therein to fall edge first onto said package between rows of eggs or the like.

2. The apparatus according to claim 1, wherein a bottom portion of said label feeder is formed in a generally open state with label supports positioned on three sides.

3. The apparatus according to claim 2, wherein a label-posture adjusting chamber has a vertical label supporting member and an opening and closing member opposing one another to form a V-shaped structure.

4. The apparatus according to claim 3, wherein said label supporting member includes a flexible guide member projecting downward on the lower end thereof.

* * * * *